United States Patent [19]

McAneney et al.

[11] Patent Number: 4,559,287

[45] Date of Patent: Dec. 17, 1985

[54] STABILIZED PHOTORESPONSIVE DEVICES CONTAINING ELECTRON TRANSPORTING LAYERS

[75] Inventors: T. Brian McAneney, Burlington; Rafik O. Loutfy, Willowdale; Beng S. Ong; Zoran D. Popovic, both of Mississauga, all of Canada

[73] Assignee: Xerox Corporation, Stamford, Conn.

[21] Appl. No.: 670,837

[22] Filed: Nov. 13, 1984

[51] Int. Cl.[4] ..... G03G 5/14

[52] U.S. Cl. ..... 430/59; 430/58; 430/900

[58] Field of Search ..... 430/58, 59, 900

[56] References Cited

U.S. PATENT DOCUMENTS

| | | | |
|---|---|---|---|
| 3,169,060 | 2/1965 | Hoegl | 96/1 |
| 3,275,684 | 9/1966 | Fritz | 260/515 |
| 3,331,687 | 7/1967 | Kosche | 96/1.5 |
| 3,607,257 | 9/1971 | Johnson | 96/1.6 |
| 3,819,693 | 6/1974 | Levine | 260/520 |
| 4,013,623 | 3/1977 | Turner et al. | 260/63 UX |
| 4,047,949 | 9/1977 | Horgan | 96/1.5 R |
| 4,115,116 | 9/1978 | Stolka et al. | 96/1.5 R |
| 4,135,928 | 1/1979 | Hashimoto et al. | 96/1.5 R |
| 4,315,981 | 2/1982 | Wiedemann | 430/59 |
| 4,474,865 | 10/1984 | Ong et al. | 430/58 |

*Primary Examiner*—Roland E. Martin

*Attorney, Agent, or Firm*—E. O. Palazzo

[57] ABSTRACT

An improved photoresponsive imaging member consisting essentially of a supporting substrate, a photogenerating layer, comprised of a photogenerating pigment optionally dispersed in an inactive resinous binder, an electron transporting layer comprised of derivatives of fluorenylidene methane dispersed in a resinous binder, and having incorporated therein a stabilizing amount of an aryl amine electron donating compound.

17 Claims, 5 Drawing Figures

STABILIZED PHOTORESPONSIVE DEVICES CONTAINING ELECTRON TRANSPORTING LAYERS

BACKGROUND OF THE INVENTION

This invention is generally directed to improved layer photoresponsive imaging members, and more specifically the present invention is directed to stabilized layered photoresponsive devices comprised of electron transporting layers having incorporated therein stabilizing compositions. In one specific embodiment of the present invention there is provided a photoresponsive imaging member or device comprised of an electron transporting layer having incorporated therein stabilizing compositions, including various diamine molecules, and a photogenerating layer. Also, in accordance with the present invention there is provided a process for affecting the stabilization of electron transporting compositions by incorporating therein various stabilizing compositions, including specific diamine molecules as illustrated herein, hydrazone compositions and other similar electron donating substances. The improved photoresponsive devices of the present invention are particularly useful in electrostatic imaging systems wherein, for example, the device is initially charged positively.

The formation and development of electrostatic latent images on surfaces of photoconductive materials by electrostatic means is well known, one such method involving the formation of an electrostatic latent image on the surface of a photoreceptor. This photoreceptor is generally comprised of a conductive substrate containing on its surface a layer of photoconductive material, and in many instances a thin barrier layer is situated between the substrate and the photoconductive layer to prevent charge injection from the substrate, as injection could adversely affect the quality of the images generated.

Numerous different xerographic photoconductive members are known including, for example, a homogeneous layer of a single material, such as vitreous selenium; or a composite layered device with a dispersion of a photoconductive composition. An example of one type of composite xerographic photoconductive member is described in U.S. Pat. No. 3,121,006 wherein there is disclosed finely divided particles of a photoconductive inorganic compound dispersed in an electrically insulating organic resinous binder. In a commercial form the binder layer contains particles of zinc oxide uniformly dispersed in a resinous binder, and coated on a paper backing. The binder material as disclosed in this patent comprises a composition which is incapable of transporting for any significant distance injected charge carriers generated by the photoconductive particles. Illustrative examples of specific binder materials disclosed include, for example, polycarbonate resins, polyester resins, polyamide resins, and the like.

There are also known photoreceptor materials comprised of other inorganic or organic materials wherein the charge carrier generation and charge carrier transport functions are accomplished by discrete contiguous layers. Additionally, layered photoreceptor materials are disclosed in the prior art which include an overcoating layerof an electrically insulating polymeric material. However, the art of exerography continues to advance and more stringent demands need to be met by the copying apparatus in order to increase performance standards, and to obtain high quality images. Additionally, photoresponsive devices are desired which can be charged positively, and contain therein an electron transporting material.

Recently, there has been disclosed layered photoresponsive devices comprised of photogenerating layers and transport layers, as described in U.S. Pat. No. 4,265,990; and overcoated photoresponsive materials containing a hole injecting layer in contact with a transport layer, an overcoating of a photogenerating layer, and a top coating of an insulating organic resin, reference, for example, U.S. Pat. No. 4,251,612. Examples of generating layers disclosed in these patents include trigonal selenium, and phthalocyanines, while examples of transport layers that may be used, which layers transport positive charges, in contrast to the transport layers of the present invention which transport electrons include certain diamines dispersed in a resinous binder. The disclosure of each of these patents, namely U.S. Pat. Nos. 4,265,990 and 4,251,612 are totally incorporated herein by reference.

Many other patents are in existence describing photoresponsive devices including layered devices with generating substances, such as U.S. Pat. No. 3,041,167. This patent discloses an overcoated imaging member with a conductive substrate, a photoconductive layer, and an overcoating layer of an electrically insulating polymeric material. This member is utilized in electrophotographic copying by, for example, initially charging the member with electrostatic charges of a first polarity, and imagewise exposing to form an electrostatic latent image, which can be subsequently developed to form a visible image. Prior to each succeeding imaging cycle, the imaging member can be charged with an electrostatic charge of a second polarity, which is opposite in polarity to the first polarity. Sufficient additional charges of the second polarity are applied so as to create across the member a net electrical field of the second polarity. Simultaneously, mobile charges of the first polarity are created in the photoconductive layer by applying an electrical potential to the conductive substrate. The imaging potential, which is developed to form the visible image, is present across the photoconductive layer, and the overcoating layer.

Furthermore, there is disclosed in U.S. Pat. No. 4,135,928 electrophotographic light sensitive members with 7-nitro-2-aza-9-fluorenylidenemalononitrile as a charge transporting substance. According to the disclosure of this patent, the electrophotographic light sensitive members comprise an electroconductive support, a layer thereof comprising a charge generating substance, and 7-nitro-2-aza-9-fluorenylidene-malononitrile, of the formula, for example, as illustrated in column 1.

Other representative patents disclosing layered photoresponsive devices include U.S. Pat. Nos. 4,115,116, 4,047,949, and 4,315,981. There is disclosed in the '981 patent an electrophotographic recording member with an organic double layer. According to the disclosure of this patent, the recording member consists of an electroconductive support material and a photoconductive layer of organic maerials, which contain a charge carrier producing dyestuff layer of a compound having an aromatic or heterocyclic polynuclear quinone ring system, and a transparent top layer of certain oxdiazoles. Apparently, this recording member is useful in electrophotographic copying processes where negative charging of the top layer occurs when an electron donating compound is selected for the device involved.

Moreover, disclosed in U.S. Pat. No. 4,442,192 entitled Improved Photoresponsive Device Containing an Electron Donating Layer, are photoresponsive devices comprised of a photoconductive composition layer, a trapping layer, and an overcoating layer containing a material capable of donating electrons. More specifically, there is disclosed in this an improved layered photoresponsive device with a conductive substrate, a photogenerating layer, a trapping layer for retaining positive charges at the interface between the overcoating layer and the trapping layer, which layer also prevents these charges from migrating into the photogenerating layer, and an overcoating layer comprised of a material capable of donating or transferring electrons to positive charges contained on the surface of the photoresponsive device, which overcoating layer consists of N,N'-diphenyl-N,N'-bis(alkylphenyl)-[1,1-biphenyl]-4,4'-diamines.

Additionally, there is disclosed in copending application U.S. Ser. No. 521,198, entitled Layered Photoresponsive Device, an imaging member comprised of a photogenerating layer, and in contact therewith an electron transporting layer comprised of fluorenylidene derivatives. The disclosure of this copending application is totally incorporated herein by reference.

While the above described photoresponsive imaging members or devices are suitable for their intended purposes, there continues to be a need for other imaging members, particularly layered imaging members. Additionally, there is a need for layered photoresponsive imaging members wherein the electron transporting materials are stabilized with specific aryl amines so as to prevent crystallization of the electron transporting molecules. Moreover, there continues to be a need for improved layered imaging members with stabilized aryl amine electron transporting layers enabling these members to be positively charged. Moreover, there continues to be a need for improved photoresponsive imaging member which can be prepared with a minimum number of processing steps, and wherein the layers are sufficiently adhered to one another to allow their continuous use in repetitive imaging and printing systems. Additionally, there continues to be a need for processes for the stabilization of electron transporting molecules by adding thereto various aryl amine stabilizing substances, as illustrated hereinafter.

SUMMARY OF THE INVENTION

It is an object of the present invention to provide improved stabilized photoresponsive imaging members.

In yet another object of the present invention there are provided stabilized layered photoresponsive imaging members with electron transporting layers.

In a further object of the present invention there are provided layered photoresponsive imaging members with a photogenerating layer, and in contact therewith an electron transporting layer containing therein derivatives of 9-fluorenylidene methane dispersed in an inactive resinous binder composition, which methanes are stabilized by diamine molecules.

In a further object of the present invention, there are provided processes for the stabilization of electron transporting layers by adding thereto specific diamine molecules, and other electron donating compositions.

In still another object of the present invention there are provided imaging methods with a stabilized photoresponsive imaging device comprised of derivatives of 9-fluorenylidene methane as an electron transporting layer, which derivatives have been stabilized against crystallization by incorporating therein various diamine substances, and other electron donating compositions.

These and other objects of the present invention are accomplished by the provision of an improved photoresponsive imaging member comprised of a photogenerating layer and an electron transporting layer in contact therewith, which layer has been stabilized, enabling crystallization thereof to be eliminated. More specifically, in accordance with the present invention there is provided an improved stabilized photoresponsive imaging member comprised of a supporting substrate, a photogenerating layer, an electron transporting layer comprised of fluorenylidene derivatives of the formula:

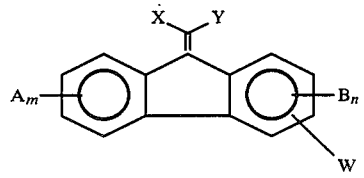

wherein X and Y are cyano groups, (CN) or alkoxycarbonyl groups (COOR) A, B, and W, are independently selected from electron withdrawing groups including acyl, alkoxycarbonyl, nitro, alkylaminocarbonyl, or derivatives thereof, m is a number of from 0 to about 2, and n is the 0 or 1; and wherein the electron transporting layer contains therein a stabilizing effective amount of aryl amine electron donating compounds, enabling crystallization of this layer to be substantially eliminated. The X and Y groups can also be selected from COR, COOR, or $CONR^1R^2$, wherein R is an alkyl group, a substituted alkyl group, substituted with alkoxy for example, an aryl group, or a carboxyclic group, and $R^1$ or $R^2$ are hydrogen, alkyl groups, or aryl groups. Additionally, in a specific embodiment of the present invention, the substituents A and B can be independently selected from alkyl groups.

The electron transporting fluorenylidene derivatives of the above formula are disclosed in copending application U.S. Ser. No. 521,198, entitled Layered Photoresponsive Device, the disclosure of which has been totally incorporated herein by reference.

With further reference to the fluorenylidene derivatives, illustrative examples of acyl groups include those of the formula RCO, wherein R is an alkyl group, such as acetyl, propionyl, isovaleryl, anisoyl, stearoyl and the like, with isovaleryl being preferred. Examples of alkoxycarbonyl groups, COOR, wherein R is an alkyl group, or derivative thereof, include methoxycarbonyl, ethoxycarbonyl, isopropoxycarbonyl, butoxycarbonyl, phenethoxycarbonyl, carbitoxycarbonyl, and the like, while illustrative examples of alkylaminocarbonyl substituents, or derivatives thereof include propylaminocarbonyl, butylaminocarbonyl, diethylaminocarbonyl, 2-methoxyethylaminocarbonyl, stearylaminocarbonyl, and the like.

Illustrative examples of alkyl groups, including alkyl groups for the electron withdrawing substituents A and B, are those of from 1 carbon atom to about 20 carbon atoms, and preferably from 1 carbon atom to about 8 carbon atoms, such as methyl, ethyl, propyl, butyl, pentyl, hexyl, octyl, nonyl, decyl, pentadecyl, stearyl, and the like. Specific preferred alkyl groups include methyl, ethyl, propyl and butyl. Aryl substituents include those of from 6 to about 24 carbon atoms, such as phenyl and napthyl.

Examples of electron transporting materials embraced within the above general formula, and suitable for the electron transporting layers of the photoresponsive devices of the present invention include those compounds as represented by the following formulas:

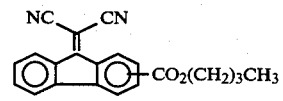

I.

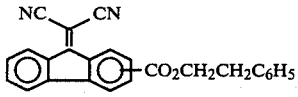

II.

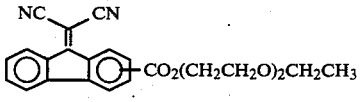

III.

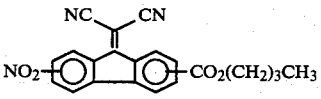

IV.

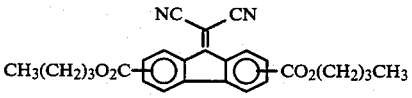

V.

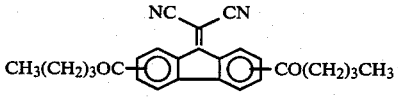

VI.

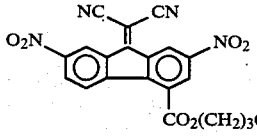

VII.

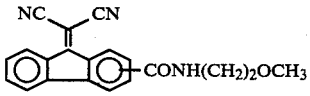

VIII.

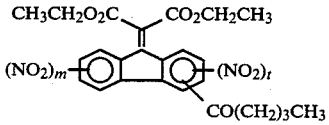

IX.

WHERE m IS 1 OR 2, t IS ZERO OR 1

The electron transporting layer is of a thickness of from about 2 microns to about 100 microns, and preferably is of a thickness of from 5 microns to about 30 microns. Also, the electron transporting compound is generally dispersed in a highly insulating and transparent resinous material or inactive resinous binder material, including those as described in U.S. Pat. No. 3,121,006, the disclosure of which is totally incorporated herein by reference. Specific examples of resinous materials are polycarbonates, acrylate polymers, vinyl-polymers, cellulose polymers, polyesters, polysiloxanes, polyamides, polyurethanes, and epoxies, as well as block random or alternating copolymers thereof. Preferred electrically inactive binder materials are polycarbonate resins having a molecular weight of from about 20,000 to about 100,000, with a molecular weight of from 50,000 to about 100,000 being particularly preferred. Generally, the resinous binder is present in the electron transporting layer in an amount of from about 25 percent by weight to about 90 percent by weight, and preferably from about 50 percent by weight to about 65 percent by weight. Other inactive resinous binder materials can be selected for the electron transporting layer providing the objectives of the present invention are achieved, including, for example, polyhydroxy ethers, such as those commercially available from Union Carbide, and the like.

The photogenerating layers can be comprised of known photoconductive charge carrier generating materials including, for example, amorphous selenium, amorphous selenium alloys, halogen-doped amorphous selenium, halogen-doped amorphous selenium alloys, trigonal selenium, selenide and carbonates doped with trigonal selenium, reference U.S. Pat. Nos. 4,232,102 and 4,233,283, the disclosures of which are totally incorporated herein by reference; cadmium sulfide, cadmium selenide, cadmium telluride, cadmium sulfur selenide, cadmium sulfur telluride, cadmium seleno telluride, copper and chlorine-doped cadmium sulfide, and the like. Alloys of selenium included within the scope of the present invention are selenium tellurium alloys, selenium arsenic alloys, selenium tellurium arsenic alloys, and preferably such alloys with a halogen material, like chlorine, in an amount of from about 50 to about 200 parts per million.

Other photogenerating compositions are metal phthalocyanines, metal-free phthalocyanines, vanadyl phthalocyanines, other known phthalocyanines, many of which are disclosed in U.S. Pat. No. 3,816,118 the disclosure of which is totally incorporated herein by reference, squaraine pigments, and the like. Preferred photogenerating substances include trigonal selenium, squaraine pigments and vanadyl phthalocyanine.

The photogenerating layers are generally of a thickness of from about 0.05 microns to about 10 microns or more, and preferably are of a thickness of from about 0.4 microns to about 3 microns, however, the thickness of this layer is primarily dependent on the photoconductive volume loading, which may vary from 5 to 100 volume percent.

The photogenerating layer generally comprises the above-described photogenerating pigments dispersed in an inactive resinous binder composition, in amounts of from about 5 percent by volume to about 95 percent by volume, and preferably in amounts of from about 25 percent by volume to about 75 percent by volume. Illustrative examples of polymeric binder resinous materials that can be selected include those as disclosed, for example, in U.S. Pat. No. 3,121,006, the disclosure of which is totally incorported herein by reference, polyesters, polyvinylbutyral, polycarbonate resins, polyvinylcarbazole, epoxy resins, phenoxy resins, especially the commercially available poly(hydroxyether)resins, and other similar substances.

With further reference to the photoresponsive imaging members, the supporting substrate layer is of a thickness of from about 1 mil to about 50 mils, and may be comprised of any suitable material having the requisite mechanical properties. Thus, the substrate layers may comprise a layer of insulating material, such as an inorganic or organic polymeric material, or a conductive material such as, for example, aluminum, chromium, nickel, brass, or the like. The substrate may be flexible or rigid, and may be of a number of many different configurations, such as, for example, a plate, a cylindrical drum, a scroll, an endless flexible belt, and the like. Preferably, the substrate is in the form of an endless flexible belt.

An important feature of the imaging members of the present invention resides in adding to the electron transporting layers comprised of the fluorenylidene derivatives various aryl amine electron donating substances for the primary purpose of substantially eliminating crystallization thereof. While it is not desired to be limited by theory it is believed that the electron donating substances added prevent the electron transporting compounds, which are electron accepters from phase separation or crystallization from the polymer matrix within whih they are dispersed. Crystallization of the electron transporting materials causes the resulting photoresponsive imaging member to exhibit decreased sensitivity, an increase in background development, and residual potentials with repeated cycling in view of the increase in charge trapping. Specifically, the resulting increase in background potential will result in decreased development potentials, and a corresponding deterioration of image quality. Furthermore, in those situations where complete crystallization or phase separation of the electron transporting materials results, the opaque transport layer formed prevents light from contacting the charge generating layer of the photoresponsive imaging member, thereby preventing the formation of electrostatic latent images. Additionally, it is known that most electron transporting materials, such as 2,4,7-trinitro-9-fluorenone (TNF) possess desirable characteristics when they are selected, for example, as the binder polymer for polyvinylcarbazoles. Apparently these characteristics are achieved in view of the charge transferring interaction between the electron acceptor, and the polyvinylcarbazole electron donor polymers, causing stabilization of the layer against crystallization resulting in relatively better electrical properties. However, when electron transporting layers are fabricated with polymers other than polyvinylcarbazole as the binder, there is substantially no charge transfer interaction occurring between the electron transporting material and the polymer, accordingly the electron accepter has a propensity to phase separate. One of the problems solved with the photoresponsive imaging members of the present invention is to substantially prevent this phase separation by the addition of effective, but small amounts of electron donor materials, including specific diamines, hydrazone compositions, and other similar substances, to the electron transporting layer. This prevents the electron transporting substances from crystallization, as a result of the charge transfer interaction between the electron donor and accepter molecules. The increased stability of the electron transporting layer that results enables the fabrication of imaging members with the electron transporting substances, wherein binder polymers other than polyvinylcarbazole can be selected, including polycarbonates; and further these imaging members possess improved electrical properties.

Examples of aryl amine compounds that may be added to the electron transporting layer substances, in an amount of from about 7 percent by weight to about 35 percent by weight, and preferably in an amount of from about 10 percent by weight to about 20 percent by weight, includes those substances of the following formula:

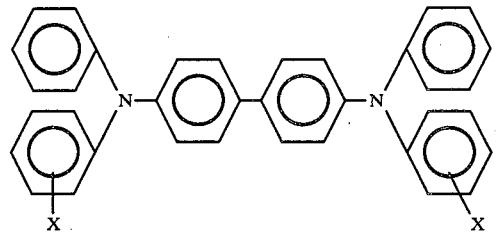

wherein X is selected from alkyl groups, preferably of from 1 to about 6 carbon atoms and halogen. More specifically, X is selected from the group consisting of (ortho) $CH_3$, (meta) $CH_3$, (para) $CH_3$, (ortho) Cl, (meta) Cl, (para) Cl. These compounds are described in detail in U.S. Pat. No. 4,265,990, the disclosure of which is totally incorporated herein by reference.

Compounds corresponding to the above formula include N,N'-diphenyl-N,N'-bis(alkylphenyl)-[1,1-biphenyl]-4,4'-diamine wherein the alkyl is selected from the group consisting of methyl such as 2-methyl, 3-methyl and 4-methyl, ethyl, propyl, butyl, and the like. With chloro substitution, the compound is N,N'-diphenyl-N,N'-bis(halo phenyl)-[1,1'-biphenyl]-4,4'-diamine, wherein the halo is 2-chloro, 3-chloro or 4-chloro, N,N'-diphenyl-N,N'-bis(3-methylphenyl)-[p-terphenyl]-4,4'-diamine, and N,N'-diphenyl-N,N'-diphenyl-N,N'-bis(phenylmethyl)-[1,1'-biphenyl]-4,4'-diamine.

The photoresponsive devices disclosed are useful in electrostatographic imaging systems, particularly colored electrostatic imaging systems, wherein the devices are initially charged positively; followed by imagewise exposure; development of the resulting latent image with a developer composition, comprised of toner resin particles, pigment particles; inclusive of cyan, magenta, and yellow, and carrier particles; followed by transferring the developed image to a suitable substrate, such as paper; and permanently affixing the image thereon.

BRIEF DESCRIPTION OF THE DRAWINGS

For a better understanding of the present invention and further features thereof reference is made to the following detailed description of various preferred embodiments wherein.

DESCRIPTION OF THE PREFERRED EMBODIMENTS

The preferred embodiments will now be illustrated with reference to specific photoresponsive imaging members illustrated hereinbefore, it being noted that equivalent compositions are also embraced within the scope of the present invention.

Figure 1:
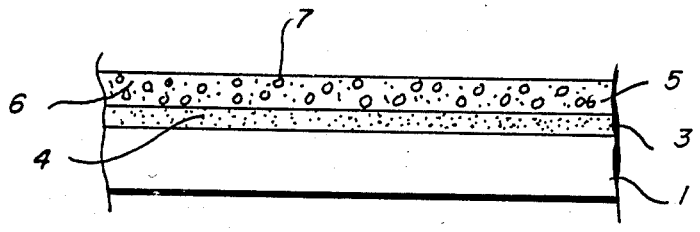
FIGS. 1 and 2 are partially schematic cross-sectional views of the photoresponsive imaging members of the present invention.

Illustrated in FIG. 1 is a photoresponsive imaging member of the present invention with a supporting substrate 1 of aluminized Mylar, in a thickness of 100 microns; a photogenerating layer 3, in a thickness of 1 micron, comprised of the photogenerating pigment trigonal selenium, which may be optionally dispersed in an inactive resinous binder composition 4; an electron transporting layer 5, in a thickness of 25 microns, comprised of the electron transporting fluorenylidene compositions illustrated hereinbefore dispersed in a polycarbonate resinous binder composition 6; and incorporated into the electron transporting layer, N,N'-diphenyl-N,N'-bis(3-methylphenyl)-[1,1'-biphenyl]-4,4'-diamine 7, in an amount of 10 percent by weight.

Figure 2:
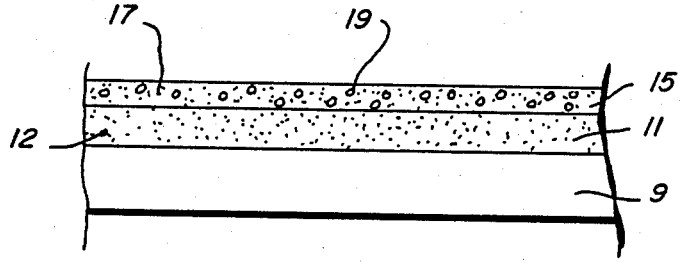

Illustrated in FIG. 2 is a further photoresponsive imaging member of the present invention comprised of a supporting aluminum conductive substrate 9, in a thickness of 200 microns; a photogenerating layer 11, comprised of trigonal selenium in an amount of 80 to 85 percent by weight, dispersed in a polycarbonate resinous binder 12; an electron transporting layer 15 comprised of the fluorenylidene derivative represented by formula 3 disclosed hereinbefore, in an amount of 47 percent by weight, dispersed in a polycarbonate resinous binder 17; and added thereto for stabilizing purposes in an amount of 15 percent by weight, N,N'-diphenyl-N,N'-bis(chlorophenyl)-[1,1'-biphenyl]-4,4'-diamine 19.

The invention will now be described in detail with respect to specific preferred embodiments thereof, it being understood that these examples are intended to be illustrative only and the invention is not intended to be limited to the materials, conditions or process parameters recited herein. All percentages and parts are by weight unless otherwise indicated.

EXAMPLE I

Preparation of (4-n-butoxycarbonyl-9-fluorenylidene)malononitrile (I)

In a 5,000-milliliter, round-bottom flask equipped with a Dean-Stark apparatus and a water condenser, were placed 100 grams (0.446 mole) of fluorenone-4-carboxylic acid, available from Aldrich Chemicals, 650 grams of n-butanol, 5 milliliters of concentrated sulfuric acid, and 2,000 milliliters of toluene. The mixture was magnetically stirred and heated under reflux for 24 hours; followed by cooling to room temperature. The n-butanol solvent was then evaporated under reduced pressure in the presence of 10 grams of sodium bicarbonate. Subsequently, 1,000 milliliters of methylene chloride was added to the residue, and the resulting solution was washed twice with dilute aqueous sodium bicarbonate solution, and twice with water. After drying with anhydrous magnesium sulfate, the solution was filtered and evaporated under reduced pressure, resulting in 120 grams of n-butyl fluorenone-4-carboxylate ester.

The resulting ester, 120 grams, was then placed in a 2,000 milliliter round-bottomed flask. To this flask was added 1,000 milliliters of absolute methanol, 59 grams (0.89 mole) of malononitrile, and 25 drops of piperidine. The mixture was stirred magnetically, and heated under reflux for 20 hours. The solid product from the cooled reaction mixture was filtered, washed twice with 100 milliliters of methanol, once with 200 milliliters of water, and dried under vacuum at 50° C. for 10 hours. The resulting product was then recrystallized from acetone and methanol, yielding 123 grams of pure (4-n-butoxycarbonyl-9-fluorenylidene)malononitrile melting point 99°–100° C.

| Calculated | Found |
|---|---|
| C, 76.81 | C, 76.52 |
| H, 4.91 | H, 5.04 |
| N, 8.53 | N, 8.28 |

The compound was further identified by spectroscopic means, with the following results:

NMR ($CDCl_3$), Delta: 1.0(t, 3H); 1.5(m, 2H); 1.8(m, 2H); 4.5(t, 2H); 7.3–8.7.t(m, 7H).

IR (KBr pellet): 2240 $cm^{-1}$ (CN); 1730 $cm^{-1}$ (C=O).

EXAMPLE II

Preparation of (4-phenethoxycarbonyl-9-fluorenylidene)malononitrile (II)

(a) Preparation of precursor (4-carboxy-9-fluorenylidene)malononitrile: A mixture of 93.1 grams (0.415 mole) of fluorenone-4-carboxylic acid, and 750 milliliters of absolute methanol was magnetically stirred and heated to reflux temperature in a 2,000 milliliter round-bottomed flask fitted with a reflux condenser. Subsequently, there was added to the flask 82.3 grams (1.25 mole) of malononitrile and 20 drops of piperidine. This mixture was then heated under reflux for 48 hours. The solid product (4-carboxy-9-fluorenylidene)malononitrile, was collected by suction filtration, and purified by stirring in 500 milliliters of boiling methanol for 15 minutes, followed by filtration and washing successively with 200 milliliters of methanol. The product, which was dried under vacuum at 65° C. for 12 hours, weighed 90.1 grams.

(b) Preparation of (4-chloroformyl-9-fluorenylidene)-malononitrile: A mixture of 27.44 grams (0.10 mole), and (4-carboxy-9-fluorenylidene)malononitrile as obtained above, and 150 milliliters of thionyl chloride in a 250 milliliter round-bottom flask equipped with a reflux condenser was magnetically stirred and heated under reflux in a dry nitrogen atmosphere for 6 hours. The solid acid dissolved after 1 hour's heating. As the reaction proceeded, the mixture was evaporated at reduced pressure resulting in a solid residue, and 300 milliliters of dichloroethane was added to this crude product. Evaporation under reduced pressure was continued to remove traces of thionyl chloride. The crude product was recrystallized from methylene chloride/hexane (350 ml/400 ml). The pure (4-chloroformyl-9-fluorenylidene)malononitrile obtained weighed 27.99 grams after drying under vacuum at 40° C. for 12 hours.

(c) Preparation of Compound (II): 8.5 grams (0.03 mole) of (4-chloroformyl-9-fluorenylidene)malononitrile was dissolved in 150 milliliters of dried methylene chloride in a 250 milliliter round-bottom flask under a dry nitrogen atmosphere. The solution was magnetically stirred at room temperature. A solution of 3.67 grams (0.03 mole) of phenethyl alcohol and 4.5 milliliters of triethylamine in 30 milliliters of methylene chloride was added dropwise by means of a pressure-equalizing dropping funnel over a period of 10 minutes. After the addition, the reaction mixture was allowed to react at room temperature for 4 hours. The mixture was poured into a 500 milliliter separatory funnel, and washed with dilute aqueous sodium bicarbonate solution, (3 times) and then water (2 times), dried with anhydrous magnesium sulfate, and filtered. The filtrate was evaporated at reduced pressure yielding Compound (II), which was recrystallized from methylene chloride/hexane. The yield of pure product was 8.3 grams. The melting point was 115°–117° C.

Analytical calculation for $C_{25}H_{16}N_2O_2$: C, 79.77; H, 4.28; N, 7.44. Found: C,79.82; H, 4.41; N, 7.42. NMR ($CDCl_3$), Delta: 3:15 (t, 2H); 4.65 (t, 2H); 7.2–8.6 (m, 12H). IR (KBr pellet); 2240 $cm^{-1}$ (CN), 1735 $cm^{-1}$ (C═O).

EXAMPLE III

Preparation of (4-carbitoxy-9-fluorenylidene)malononitrile (III)

A solution of 4.0 grams (0.0138 mole) of (4-chloroformyl-9-fluorenylidene) as obtained in Example II(b) in 75 milliliters of methylene chloride was magnetically stirred in a 200 milliliter round-bottomed flask under a dry nitrogen atmosphere. Thereafter, 2.1 milliliters (0.0152 mole) of 2-(2-ethoxyethoxy)ethanol (carbitol) was added, followed by the addition of a solution of 2.1 milliliters of triethylamine in 5 milliliters of methylene chloride over a period of 3 minutes. The reaction mixture became cloudy due to the formation of triethylammonium chloride. The resulting mixture was allowed to react at room temperature for 4 hours. The reaction mixture was then treated in accordance with Example II(c). The yield of pure Compound (III) was 4.08 grams. The melting point was 75.5°–76° C.

Analytical calculation of $C_{23}H_{20}N_2O_4$: C, 71.12; H, 5.19; N, 7.21. Found: C,71.01; H, 5.21; N, 7.21. NMR ($CDCl_3$), Delta: 1.2 (t, 3H); 3.4–4.0 (m, 8H); 4.6 (t, 2H); 7.2–8.6 (m, 7H).

IR (KBr pellet): 2240 $cm^{-1}$ (CN); 1730 $cm^{-1}$ (C═O).

EXAMPLE IV

Preparation of Diethyl(4-n-butoxycarbonyl-2,7-dinitro-9-fluorenylidene)-malonate CIX)

11.2 grams (0.05 mole) of fluorenone-4-carboxylic acid was placed in a 500-milliliter round-bottomed flask. There was then added to the flask at room temperature 300 milliliters of red fuming nitric acid over a period of 10 minutes. This was followed by the addition of 50 milliliters of concentrated sulfuric acid over a period of 5 minutes. The resulting solution was stirred at room temperature for 10 minutes and then poured slowly into 1.5 liters of ice-cold water with constant swirling. The solid product, 2,7-dinitrofluorenone-4-carboxylic acid, was collected by suction filtration, washed with 100 milliliters of 5 percent aqueous hydrochloric acid solution, and dried in a vacuum at 60° C. for 24 hours. The dry weight of 2,7-dinitrofluorenone-4-carboxylic acid was 13.3 grams.

The conversion of 2,7-dinitrofluorenone-4-carboxylic acid (9.42 grams about 0.03 mole) into the corresponding n-butyl ester was affected in accordance with the procedure of Example I. The ester was purified by recrystallization from methylene chloride and hexane and the yield was 7 grams.

In a 200 -milliliter round-bottomed flask, there was then placed 4 grams (0.011 mole) of the n-butyl, 2,7-dinitrofluorenone-4-carboxylate, 2.5 milliliters (0.016 mole) of distilled diethyl malonate and 25 milliliters of methylene chloride. The solution was stirred magnetically and cooled with an ice-bath under a dry nitrogen atmosphere. To this solution was added 7 milliliters (0.065 mole) of titanium tetrachloride over a period of 5 minutes, followed by the addition of 10.4 milliliters (0.13 mole) of pyridine. The reaction mixture was then stirred at room temperature for 2 hours before being treated with 125 milliliters of water. The organic layer was separated in a separatory funnel, washed with 5 percent aqueous sodium bicarbonate solution and then with water. The organic solution was dried and evaporated to give the crude product which was recrystallized from isopropanol. The yield of diethyl(4-n-butoxycarbonyl-2,-7dinitro-9-fluorenylidene)malonate was 4.6 grams, m.p., 116.5°–117° C.

Analytical calculation for $C_{25}H_{24}N_2O_{10}$: C, 58.59; H, 4.72; N, 5.46. Found: C,58.57; H, 4.90; N, 5.35. NMR ($CDCl_3$), delta: 1.0–2.0 (m, 13H); 4.3–4.9 (m, 6H); 8.2–9.0 (m, 5H). IR (KBr pellet): 1735 $cm^{-1}$ (C═O); 1540 $cm^{-1}$ (C—$NO_2$).

EXAMPLE V

The stabilizing effect of the electron donor molecule N,N'-diphenyl-N,N'-bis(3-methylphenyl)-[1,1'-biphenyl]-4,4'-diamine on the electron transporting material (I) was then demonstrated using spectroscopic techniques.

Figure 3:
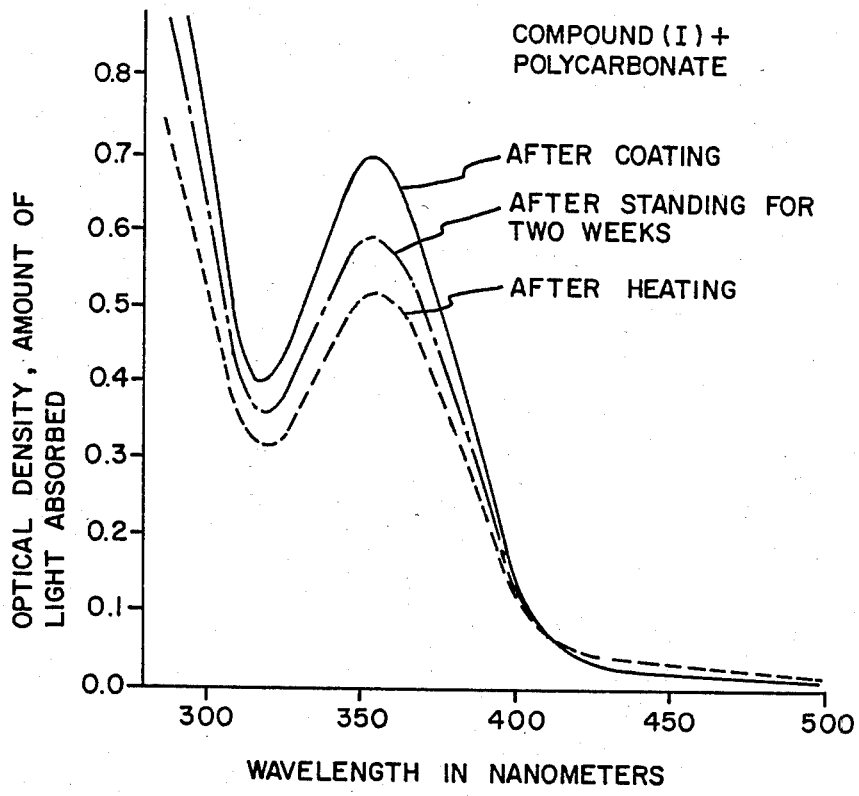
FIGS. 3, 4, and 5, are line graphs illustrating the improved properties with the imaging members of the present invention.
Figure 4:
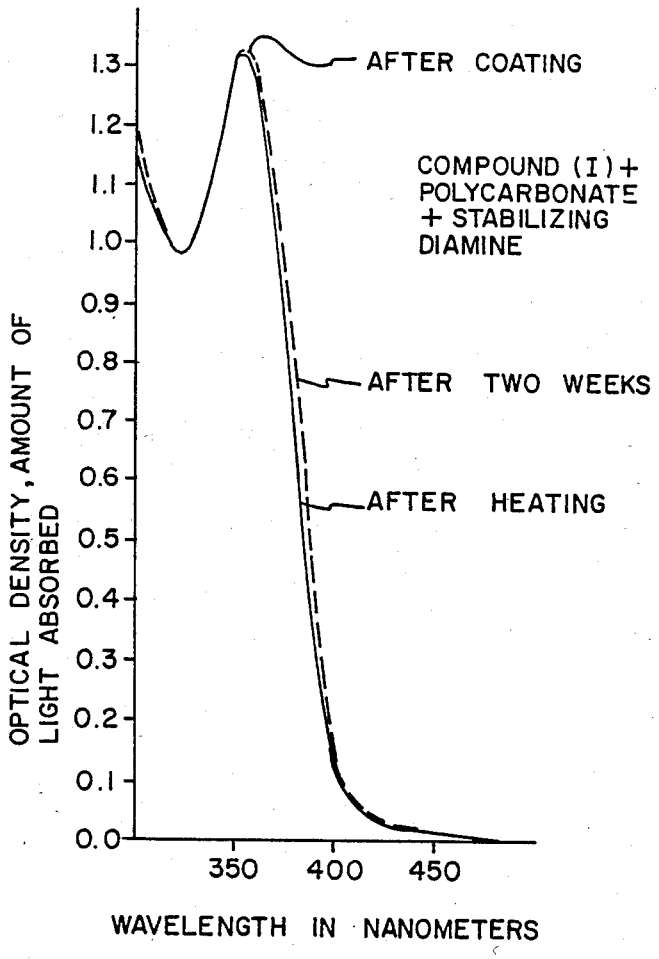

Two thin films (sub micron) were spin coated on glass slides. The first film was coated from a solution containing compound (I) and Makrolon polycarbonate ($3.96\times10^{-3}$ moles of I/gram of polymer) in methylene chloride. The second film was coated from a solution containing compound I ($3.96\times10^{-3}$ moles of I/gram of polymer), and Makrolon polycarbonate; and the diamine in methylene chloride. The molar ratio of compound (I) to the electron donor diamine compound was 3.6 to 1. The visible absorption spectra, reference FIGS. 3 and 4, of both films were measured, on a spectrophotometer, cary 17, immediately after drying, then two weeks later, and finally after heating for a period of 30 minutes at 50° C. FIG. 3 shows that the film without the stabilizing diamine had an initial broader spectrum (width of the spectrum), and that this spectrum evidenced marked changes with time and after heating. This indicated aggregation (crystallization) of compound (I), reference Spectroscopy of Dyes in Polymer Matrices, Macromolecules, 14, 587, 1981, the disclosure of which is totally incorporated herein by reference. FIG. 4 shows that the film which contained the stabilizing diamine exhibited an initial sharp absorption spectrum, and further this spectrum evidenced no significant change with time or upon heating. This is indicative of a stable film in which compound (I) has not crystallized.

EXAMPLE VI

The thermally stimulated current technique (TSC) was used to demonstrate the improved electrical properties of prepared photoresponsive devices which were stabilized with N,N'-diphenyl-N,N'-bis(3-methylphenyl)-[1,1'-biphenyl]-4,4'-diamine.

A dispersion of a photogenerating layer obtained from ball milling a mixture of 0.27 grams of bis(N,N'-dimethylaminophenyl)-squaraine, and 0.63 grams of Vitel PE-200 polyester (Goodyear), in 15 milliliters of methyl-ethylketone/toluene (4:1 by volume) for 24 hours was used to coat two identical generator layers on top of aluminized Mylar by means of a Bird Film applicator. After drying both layers in a forced air oven at 135° C. for 6 minutes, two 0.8 micron thick squaraine photogenerating layers were obtained.

A charge transport solution prepared from 1.04 grams of electron transporting compound (I) and 1.00 grams of Makrolon polycarbonate dissolved in 14 milliliters of methylene chloride was then coated on top of one of the squaraine generator layers by means of a Bird Film applicator. A second charge transport solution prepared from 1.04 grams of electron transporting compound (I), 1.00 grams of polycarbonate, and 0.41 grams of the stabilizing diamine of Example V dissolved in 18 milliliters of methylene chloride was then coated on top of the second squaraine generator layer. Both devices were dried in a forced air oven at 130° C. for 30 minutes and 20 micron transport layers were obtained. A semi-transparent aluminum electrode (transmission approximately 25%) was then evaporated on top of each of the transport layers.

The unstabilized device was placed in the cell of the TSC apparatus and cooled rapidly, in the dark, to approximately 100° K. An electric field of 20 V/micron was applied across the device, which was then illuminated for 3 minutes with 830 nanometer light to provide an effective exposure of 20 ergs/cm$^2$. The squaraine pigment generates charge very efficiently in the near IR. After exposure the device temperature was increased (with the field still applied) at a constant rate of 4° K./minute, and the thermally stimulated current was recorded as a function of temperature. This procedure was then repeated for the stabilized device.

The currents obtained for the amine stabilized device were approximately double those measured for the unstabilized device, that is 1.1 vs 0.6 ($10^{-10}$ amps) at an electric field of 20 volts/per micron. The higher currents obtained for the device with the diamine were a direct result of the increased stability of this device, that is, the addition of the diamine, which prevented crystallization of compound (I), and thus less charge trapping occured.

EXAMPLE VII

Seven photoresponsive layered devices were prepared with the electron transporting material (I) in Makrolon polycarbonate, with and without N,N'-diphenyl-N,N'-bis(3-methylphenyl)-[1,1'-biphenyl]-4,4'-diamine present, as the transport layers. Four of the devices did not contain the stabilizing diamine, and each had a different loading of compound (I). The remaining three devices contained the stabilizing diamine, and also had different loadings of compound (I). All of the devices had trigonal selenium in PVK as the generator, prepared as follows:

A 2-micron thick photogenerating layer comprising trigonal selenium, N,N'-diphenyl-N,N'-bis(3-methylphenyl)-[1,1'-biphenyl]-4,4'-diamine, (U.S. Pat. No. 4,265,990) in PVK was prepared by coating a dispersion of these materials in tetrahydrofurane (THF)/toluene over an aluminized Mylar substrate, of a thickness of 3 mils with a Bird Film applicator, and followed by drying in a forced air oven at 135° C. for 5 minutes. The dispersion was prepared by ball milling 0.8 gram of trigonal selenium, and 0.8 gram of PVK in 7 milliliters each of THF and toluene, followed by diluting with 5.0 grams of resulting slurry with a solution of 0.12 grams of the diamine in 2.5 milliliters each of THF and toluene.

A charge transport solution prepared from 0.49 gram of electron transporting compound (I) and 1.00 gram of Makrolon polycarbonate dissolved in 9 milliliters of methylene chloride was then coated on top of one of the trigonal selenium photogenerating layers by means of a Bird Film applicator. The resulting device was then dried in a forced air oven at 130° C. for 30 minutes and a 19 micron thick dry transport layer was obtained. Three more devices were then prepared using identical procedures to those outlined above, with the exception that the loading of compound (I) was different in each of the charge transport solutions coated, that is, 0.66 gram of (I) and 1.00 gram of Makrolon polycarbonate in 10 milliliters of methylene chloride; 1.00 gram of (I) and 1.00 gram of polycarbonate in 12 milliliters of methylene chloride; and 1.30 grams of (I) and 1.00 gram of polycarbonate in 14 milliliters of methylene chloride.

Figure 5:
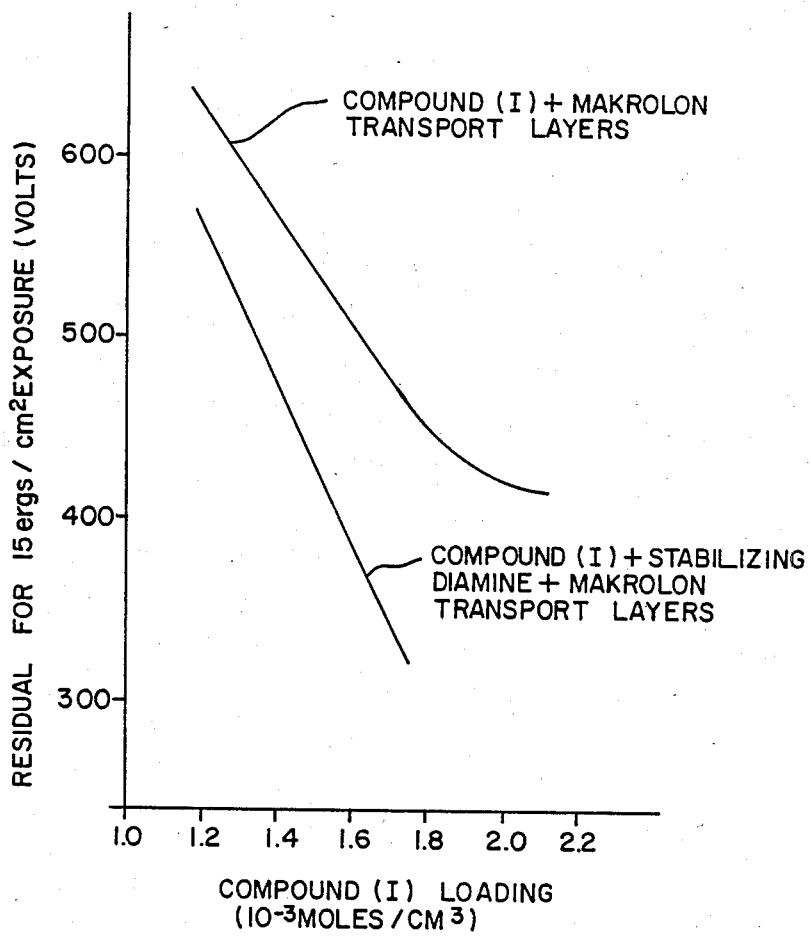

A second set of three photoresponsive devices were prepared where the stabilizing diamine was added. A charge transporting solution prepared from 0.60 gram of electron transporting materials (I), 1.00 gram of Makrolon polycarbonate and 0.24 gram of the stabilizing diamine in 11 milliliters of methylene chloride was then coated on top of one of the trigonal selenium photogenerating layers by means of a Bird Film applicator. The resulting device was then dried in a forced air oven at 130° C. for 30 minutes and a 19 micron thick dry transport layer was obtained. Two more devices were prepared using identical procedures to those outlined above, except that the loading of compound (I) was different in each of the charge transporting solutions coated and the loading of the stabilizing diamine was adjusted so that it was always present at an approximate 1:4 molar ratio relative to compound (I); 1.05 grams of (I), 1.00 gram of polycarbonate; 0.41 gram of the diamine in 15 milliliters of methylene chloride, and 1.30 grams of (I), 1.00 gram of polycarbonate and 0.52 gram of the diamine in 17 milliliters of methylene chloride. Subsequently all seven photoresponsive devices were cooled to room temperature and tested electrically by charging positively to fields of 40 volts/micron, and followed by discharging with white light (400–700 nm) exposures. FIG. 5 illustrates the residual potentials for each device, after a 15 ergs/cm$^2$ exposure, plotted as a function of the electron transporting material loading, $10^{-3}$ moles/cm$^3$. As illustrated with these graphs, for any given loading of the electron transporting compound the residual potential obtained is always lower for devices with the stabilizing diamine. The higher residual potential obtained for the non-stabilized devices are believed caused by charge trapping caused by partial crystallization of compound (I). Therefore, when the stabilizing diamine is added crystallization of (I) is prevented resulting in significantly improved electrical properties for these devices, that is, lower residual potentials at a specific exposure, and a certain loading of the electron transporting compound.

EXAMPLE VIII

The following example illustrates the preparation of photoresponsive layered devices with compound (III) as the electron transporting molecule; with and without the stabilizing diamine of Example VII present, and trigonal selenium as the generator layer.

There was prepared two trigonal selenium generator layers in a thickness of 2 microns on aluminized Mylar by repeating the procedure of Example VII. A charge transport solution prepared from 1.23 grams of electron transporting compound (III), and 1.00 gram of polycarbonate dissolved in 15 milliliters of methylene chloride was then coated on top of one of the trigonal selenium generator layers by means of a Bird Film applicator. A second charge transport solution prepared from 1.23 grams of electron transporting compound (III), 1.00 gram of polycarbonate and 0.41 grams of the stabilizing diamine dissolved in 18 milliliters of methylene chloride was then coated on top of the second trigonal selenium generator layer. Both devices were dried in a forced air oven at 130° C. for 30 minutes and 15 micron thick transport layers were obtained. After cooling to room temperature, and allowing to stand for several hours it was observed that the device with no stabilizing diamine showed complete crystallization (phase separation) of the electron transporting compound (III). Thus, the top layer of this device was opaque. Thus, substantially no incident light could reach the bottom generator layer. In contrast, the stabilized device remained perfectly transparent, and when tested electrically by charging positively to fields of 50 volts/microns, and discharging with a white light (400–700 nm) exposure of 47 ergs/cm$^2$, and a white light erase of 700 ergs/cm$^2$ there resulted an initial residul potential of 110 V. This residual remained constant when the device was subjected to repeated cycling.

EXAMPLE IX

The following example illustates photoresponsive layered devices with compound (I) as the electron transporting molecule, with and without the stabilizing diamine present, and vanadyl phthalocyanine as the generator layer.

There was prepared two vanadyl phthalocyanine generator layers in a thickness of 2 microns on ball grained aluminum by repeating the procedure of Example XI. A charge transport solution prepared from 1.04 grams of electron transporting compound (I) and 1.00 gram of Makrolon polycarbonate dissolved in 15 milliliters of methylene chloride was then coated on top of one of the phthalocyanine generator layers by means of a Bird Film applicator. A second charge transport solution prepared from 1.04 grams of electron transporting compound (I), 1.00 gram of polycarbonate and 0.41 gram of stabilizing diamine dissolved in 18 milliliters of methylene chloride was then coated on top of the second phthalocyanine generator layer. Both devices were dried in a vacuum oven at room temperature for a period of 16 hours and 15 micron thick transport layers were obtained. Subsequently, both photoresponsive devices were tested electrically by charging positively to fields of 50 volts/micron and discharging using white light exposures (400–700 nm). The device without the stabilizing diamine provided an $E_{\frac{1}{2}}$ value of 56 ergs/cm$^2$, whereas the device containing the stabilizing diamine showed greater sensitivity, that is an $E_{\frac{1}{2}}$ value of 35 ergs/cm$^2$. The increased sensitivity of the stabilized device is due to the lack of crystallization of compound (I) thus no significant charge trapping was occurring in this device. Both devices were also subjected to repeated cycling of charging, exposure and erase. After 100 cycles the residual potential of the unstabilized device had increased by 200 volts whereas the residual potential of the stabilized device remained constant. The increase in residual potential for the unstabilized device was due to crystallization of compound (I). The constant residual potentials obtained for the stabilized device indicate that no crystallization occurred.

EXAMPLE X

The following example illustrates photoresponsive layered devices having compound (I) as the electron transporting molecule, with and without the stabilizing diamine present, and trigonal selenium as the generator layer.

There was prepared two trigonal selenium generator layers in a thickness of 2 microns on aluminized Mylar by repeating the procedure of Example VII.

There was prepared two electron transport layers one without the stabilizing diamine, the other with the diamine according to the procedure of Example IX. Both devices were dried in a forced air oven at 130° C. for 30 minutes and 15 micron thick transport layers were obtained. Subsequently, both devices were cooled to room temperature and tested electronically by charging positively to fields of 50 volts/micron and discharging with white light exposures (400–700 nm). The unstabilized device provided an $E_{\frac{1}{2}}$ value of 7 ergs/cm$^2$ whereas the stabilized device showed greater sensitivity having an $E_{\frac{1}{2}}$ value of 5 ergs/cm$^2$. Both devices were also subjected to repeated cycling of charging, exposure and erase. After 300 cycles the residual potential of the unstabilized device had increased by 40 volts, whereas the residual potential of the stabilized device remained constant.

EXAMPLE XI

Two photoresponsive layered devices containing compound (II) as the electron transporting molecule, with and without N,N'-di-m-tolyl-N,N'-diphenylbenzidine added, and phthalocyanine pigments as the generator layer were prepared as follows:

A dispersion of a photogenerating layer obtained from ball milling a mixture of 0.234 gram of vanadyl phthalocyanine and 0.541 gram of 49,000 polyester resin (DuPont) in 10 milliliters of methylene chloride for 3 hours was used to coat two identical generator layers on top of ball grained aluminum substrates by means of a Bird Film applicator. After drying both layers in a vacuum oven at 55° C. for 16 hours, 2 micron thick phthalocyanine layers were obtained.

A charge transport solution prepared from 1.19 grams of electron transporting compound (II) and 1.00 gram of Makrolon polycarbonate dissolved in 15 milliliters of methylene chloride was then coated on top of one of the vanadyl phthalocyanine generator layers by means of a Bird Film applicator. A second charge transport solution prepared from 1.19 grams of electron transporting compound (II), 1.00 gram of polycarbonate and 0.41 gram of the stabilizing benzidine dissolved in 18 milliliters of methylene chloride was then coated on top of the second vanadyl phthalocyanine generator layer. Both devices were dried in a forced air oven at 130° C. for 30 minutes and two 14 micron thick transport layers were obtained. Subsequently, both photoresponsive devices were cooled to room temperature and tested electronically by charging positively to fields of 50 volts/micron and discharging with white light (400–700 nm) exposures. The device without the stabilizing diamine provided an initial residual voltage of 450 volts which on repeated cycling (10 times) increased to 600 volts. In contrast, the device with the stabilizing benzidine provided an initial residual potential of 240 volts, which on repeated cycling (10 times) remained constant. The high residual potential and increase in this potential with repeated cycling for the device which did not contain the stabilizing diamine was due to partial crystallization of compound (II) resulting in charge trapping and a build up of this trapped charge with repeated cycling. The second device with the stabilizing diamine provided a significantly lower initial residual potential which remained constant with cycling, indicating that no crystallization of compound (II) had taken place. Furthermore, after several weeks the device which did not contain the stabilizing diamine appeared cloudy indicating further crystallization of compound (II) whereas the device with the stabilizing diamine remained perfectly clear.

Although the invention has been described with reference to specific preferred embodiments, it is not intended to be limited thereto but rather those skilled in the art will recognize that variations and modifications may be made therein which are within the spirit of the invention and within the scope of the following claims.

What is claimed is:

1. An improved photoresponsive imaging member consisting essentially of a supporting substrate, a photogenerating layer, comprised of a photogenerating pigment, an electron transporting layer comprised of derivatives of fluorenylidene methane dispersed in a resinous binder, and having incorporated therein a stabilizing amount of an aryl amine electron donating compound.

2. A photoresponsive imaging member in accordance with claim 1, wherein the supporting substrate is aluminum.

3. A photoresponsive imaging member in accordance with claim 1, wherein the photogenerating layer is selected from the group consisting of inorganic photogenerating pigments, and organic photogenerating pigments.

4. A photoresponsive imaging member in accordance with claim 3, wherein the photogenerating pigments are selected from the group consisting of metal phthalocyanines, and metal-free phthalocyanines.

5. A photoresponsive imaging member in accordance with claim 4, wherein the phthalocyanine is vanadyl phthalocyanine.

6. A photoresponsive imaging member in accordance with claim 3, wherein the photogenerating layer is comprised of trigonal selenium.

7. A photoresponsive imaging member in accordance with claim 1, wherein the electron transporting derivative is of the formula

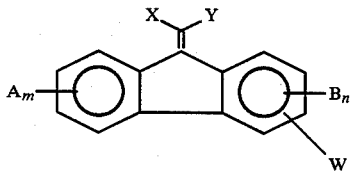

wherein X and Y are selected from the group consisting of cyano groups, (CN) and alkoxycarbonyl broups (COOR) A, B, and W, are independently selected from electron withdrawing groups including acyl, alkoxycarbonyl, nitro, alkylaminocarbonyl, or derivatives thereof, m is a number of from 0 to about 2, and n is the 0 or 1.

8. A photoresponsive imaging member in accordance with claim 1, wherein the electron transporting derivative is of the formula

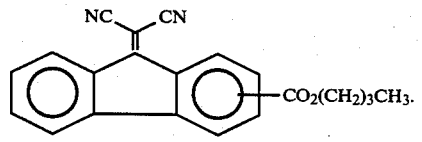

9. A photoresponsive imaging member in accordance with claim 1, wherein the electron transporting derivative is of the formula

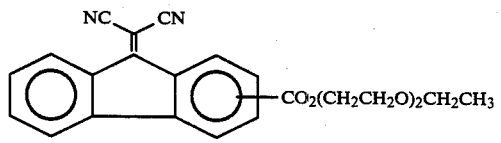

10. A photoresponsive imaging member in accordance with claim 1, wherein the electron donating compound is present in an amount of from about 1 percent to about 25 percent by weight.

11. A photoresponsive imaging member in accordance with claim 1, wherein the electron donating stabilizing composition is comprised of a aryl diamine of the following formula:

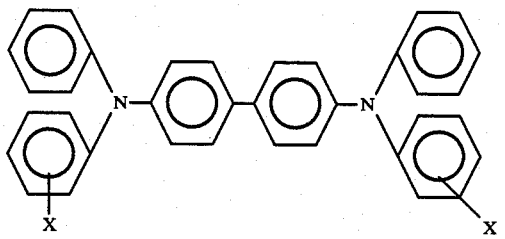

wherein X is selected from the group consisting of alkyl, and halogens.

12. A photoresponsive imaging member in accordance with claim 11, where X is selected from the group consisting of ortho $CH_3$, meta $CH_3$, para $CH_3$, ortho Cl, meta Cl, and para Cl.

13. A photoresponsive imaging member in accordance with claim 11, wherein the aryl amine is N,N'-diphenyl-N,N'-bis(3 methylphenyl)-[1,1'-biphenyl]-4,4'-diamine.

14. A photoresponsive imaging member in accordance with claim 11, wherein the resinous binder for the electron transporting layer is comprised of polycarbonate resins.

15. A photoresponsive imaging member in accordance with claim 11, wherein the aryl amine is present in an amount of from about 7 percent by weight to about 35 percent by weight, and wherein crystallization of the electron transporting compound is substantially eliminated.

16. A photoresponsive imaging member in accordance with claim 1, wherein the photogenerating pigment is dispersed in an inactive resinous binder.

17. An improved imaging member in accordance with claim 15, wherein the resinous binder is a phenoxy polymer.

* * * * *